US008336457B2

(12) United States Patent
Weihs et al.

(10) Patent No.: US 8,336,457 B2
(45) Date of Patent: Dec. 25, 2012

(54) REACTIVE COMPOSITE MATERIAL STRUCTURES WITH ELECTROSTATIC DISCHARGE PROTECTION AND APPLICATIONS THEREOF

(75) Inventors: Timothy P. Weihs, Baltimore, MD (US); Etienne Besnoin, Baltimore, MD (US); Ramzi Vincent, Columbia, MD (US); Somasundaram Valliappan, Timonium, MD (US); Ellen Heian, Cockeysville, MD (US); David Van Heerden, Baltimore, MD (US); Timothy Ryan Rude, Baltimore, MD (US); Omar Knio, Timonium, MD (US); Ronald Spraker, Red Lion, PA (US); Yuping Lin, Lutherville, MD (US)

(73) Assignee: Nanofoil Corporation, Utica, NY (US)

( * ) Notice: Subject to any disclaimer, the term of this patent is extended or adjusted under 35 U.S.C. 154(b) by 1282 days.

(21) Appl. No.: 11/454,091

(22) Filed: Jun. 15, 2006

(65) Prior Publication Data

US 2011/0070460 A1 Mar. 24, 2011

Related U.S. Application Data

(60) Provisional application No. 60/781,671, filed on Mar. 13, 2006, provisional application No. 60/692,857, filed on Jun. 22, 2005, provisional application No. 60/692,822, filed on Jun. 22, 2005.

(51) Int. Cl.
*F42B 3/18* (2006.01)

(52) U.S. Cl. ..... 102/202.2; 29/17.1; 29/17.3; 29/887; 29/529.1; 428/615; 149/14; 149/15; 228/122.1; 228/124.5; 228/234.3

(58) Field of Classification Search ..... 102/202.2, 102/202.5, 202.1; 29/17.1, 17.3, 887, 529.1; 428/548, 557, 607, 615; 149/14, 15; 228/122.1, 228/124, 5, 234.3
See application file for complete search history.

(56) References Cited

U.S. PATENT DOCUMENTS

| | | | | |
|---|---|---|---|---|
| 5,427,872 | A * | 6/1995 | Shen et al. | 429/142 |
| 6,192,802 | B1 * | 2/2001 | Baginski | 102/202.2 |
| 7,383,774 | B1 * | 6/2008 | Koehler et al. | 102/249 |
| 2006/0051609 | A1 * | 3/2006 | Banker et al. | 428/617 |

OTHER PUBLICATIONS

"ESD Association Standard Test Method for Electrostatic Discharge Sensitivity Testing—Human Body Model (HBM) Component Level", ANSI/ESD-STM5.1-2001, pp. i-iv, pp. i-ii and pp. 1-13 (2001), Electrostatic Discharge Association, Rome, New York, United States.

* cited by examiner

*Primary Examiner* — J. Woodrow Eldred
(74) *Attorney, Agent, or Firm* — Polster, Lieder, Woodruff & Lucchesi, L.C.

(57) ABSTRACT

Applicants have discovered that electrostatic discharge (ESD) may, in some circumstances, result in current densities sufficient to ignite unprotected reactive composite materials. They have further discovered that a reactive composite material (RCM) can be protected from ESD ignition without adversely affecting the desirable properties of the RCM by the application of conducting and/or insulating materials at appropriate locations on the RCM. Thus ESD-protected RCM structures can be designed for such sensitive applications as ignition of propellants, generation of light bursts, and structural materials for equipment that may require controlled self-destruction.

40 Claims, 6 Drawing Sheets

REACTIVE COMPOSITE MATERIAL STRUCTURES WITH ELECTROSTATIC DISCHARGE PROTECTION AND APPLICATIONS THEREOF

CROSS-REFERENCE TO RELATED APPLICATIONS

The present application claims the benefit of U.S. Provisional Patent Application Ser. No. 60/781,671 filed on Mar. 13, 2006, U.S. Provisional Patent Application Ser. No. 60/692,857 filed on Jun. 22, 2005, and U.S. Provisional Patent Application Ser. No. 60/692,822 filed Jun. 22, 2005, all of which are herein incorporated by reference.

STATEMENT REGARDING FEDERALLY SPONSORED RESEARCH

The United States Government has certain rights in this invention pursuant to Award 70NANB3H3045 supported by NIST.

FIELD OF THE INVENTION

This invention relates to reactive composite material structures (RCM structures), such as reactive multilayer foils, and in particular, to arrangements for protecting RCM structures from unwanted ignition as by electrostatic discharge (ESD). It also concerns applications of the thus-protected structures.

BACKGROUND OF THE INVENTION

Reactive composite materials (RCMs) are nanostructured materials comprising two or more solid materials with large negative heats of mixing, such as nickel and aluminum, spaced in a controlled fashion throughout a composite in uniform layers, local layers, islands, or particles. These materials are ignitable to support self-propagating exothermic chemical reactions. The reactions typically travel along the RCMs at speeds ranging from about 0.1 m/s to about 100 m/s.

RCMs may be produced via vapor deposition, mechanical deformation, or electrodeposition. Methods of making and using RCM structures are disclosed in the U.S. Pat. No. 6,736,942 entitled "Freestanding Reactive Multilayer Foils" ("the '942 patent"), which is incorporated herein by reference and in U.S. provisional application 60/692,822 to Xun, et al. filed Jun. 22, 2005, entitled "Methods Of Making Reactive Composite Structures, Resulting Products And Applications Thereof".

Self-propagating reactions in RCMs are driven by a reduction in chemical bond energy. Upon the application of a suitable stimulus to ignite, a local bond exchange between constituents of the RCM produces heat that is conducted through the RCM to drive the reaction. Recent developments in RCM technology have shown that it is possible to carefully control the ignition threshold and the heat and velocity of the reaction. For instance, it has been demonstrated that the velocities, heats, and/or temperatures of the reactions in an RCM can be controlled by varying the thicknesses or scale of the reactant regions and that the heats of reaction can be controlled by modifying the RCM composition or by low-temperature annealing of the RCM after fabrication.

These technological advances have widened the scope of potential applications of RCMs. Important applications include: (a) reactive multilayer joining (see, for example, U.S. patent application Ser. No. 10/843,352 filed May 12, 2004 which is incorporated herein by reference); (b) hermetic sealing (see, for example, U.S. patent application Ser. No. 10/814,243 filed Apr. 1, 2004, incorporated herein by reference); (c) structural elements that are capable of releasing energy; and (d) initiating secondary reactions, as in flares, detonators and propellant-based devices.

Several different approaches have been employed for igniting self-propagating reactions in RCMs. Such techniques are described in U.S. patent application Ser. No. 10/959,502 (the '502 application) filed Oct. 7, 2004 which is incorporated herein by reference. The stimuli include electric current, mechanical impact, friction, induction heating, microwave radiation, and laser radiation. It is desirable to protect RCMs from unwanted ignition from accidental exposure to such stimuli.

SUMMARY OF THE INVENTION

Applicants have discovered that accidental exposure to stimuli such as electrostatic discharge (ESD) may, in some circumstances, result in current densities sufficient to ignite unprotected reactive composite materials. They have further discovered that reactive composite material (RCM) can be protected from unwanted ignition without adversely affecting the desirable properties of the RCM by layers of conducting and/or insulating materials at appropriate locations on the RCM. Thus protected RCM structures can be designed for such sensitive applications as joining, ignition of propellants, generation of light bursts, and structural materials.

BRIEF DESCRIPTION OF THE SEVERAL VIEWS OF THE DRAWINGS

The advantages, nature, and various additional features of the invention will appear more fully upon consideration of the illustrative embodiments now to be described in detail in connection with the accompanying drawings. In the drawings FIG. 1 schematically illustrates an RCM foil with a metal layer on the top surface, a metallized polymer layer on the bottom surface, and a conducting tape around the edges.

DETAILED DESCRIPTION OF THE PREFERRED EMBODIMENTS

Figure 1:
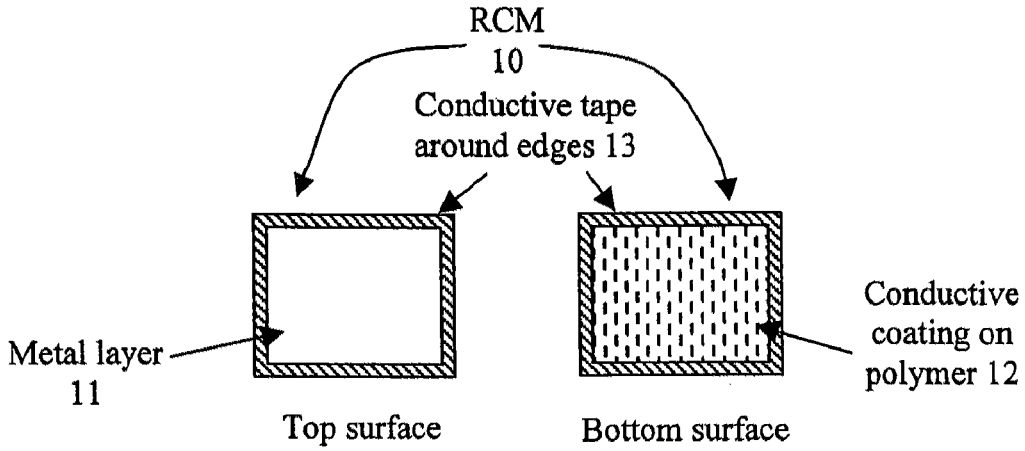

This detailed discussion is divided into two parts. Part I discusses ESD protective layers for a variety of RCM applications, and Part II describes advantageous embodiments.

I. ESD Protective Layers for RCM Applications

Applicants have discovered that electrostatic discharge (ESD) through an RCM may result in a current density high enough to ignite the RCM. The current density required to ignite an RCM depends on intrinsic properties of the RCM, including the spatial distribution, size and intermixing of the constituents of the RCM, their interdiffusion behaviors, and their electrical conductivities, as well as extrinsic properties, such as the shape of the RCM and the location of the current path through it. Applicants have further determined that the sensitivity of an RCM to ignition via ESD can be reduced without adversely affecting desirable behavior of the RCM by the application of insulative and/or conducting layers to various portions of the RCM. The layers are disposed to change, reduce, or eliminate the path of the ESD current through the RCM. The layers also reduce unwanted ignition by other stimuli.

One measure of ESD protection is provided by testing with the Human Body Model as described in ANSI standard ANSI-STM5.1-2001. Applicants believe that the embodiments described herein can provide protected RCMs that are self-propagating and classifiable as class 3B or better when so tested under the ANSI standard.

A typical RCM structure is in the form of a thin reactive multilayer foil or a thicker three dimensional structure. In a thin RCM foil, the two major surfaces and the edges are the most pertinent geometric zones for ESD control. In a thicker, three-dimensional RCM structure, such as a cube, the faces, edges, and corners are the most pertinent zones. It is convenient to treat the zones separately, as the likelihood of ignition can vary based on which zone an ESD pulse hits.

In a thin foil, the edges are typically more sensitive than the surfaces, due to both the orientation of the layers and the thinness of the edges. If an ESD arc impinges on an edge, the arc is constrained to the thickness of the foil, whereas if the arc impinges on a surface, it may spread in two dimensions. Thus for a given ESD voltage, the ESD arc current density at the edge is higher than on a surface. The layer orientation also affects ignition sensitivity because the electrical resistance in the foil parallel to the plane of the layers is lower than the electrical resistance perpendicular to the plane. For a given voltage, lower resistance allows more current to flow, which produces more heat. Thus, a voltage imposed from an electrode to the edge of a foil generates more heat than the same voltage imposed from the electrode to the surface of the foil.

Applicants have developed strategies for protecting RCMs from ESD without impeding the use of the RCM for specific applications. In various applications, the surfaces, edges, or corners of an RCM must be exposed. For example, they typically need to be exposed for ignition of the RCM, for heat transfer from the RCM to its surroundings in such applications as heaters and igniters, for wetting with molten solder or braze layers in joining applications, or for light transmission in such applications as flares and non-lethal confusion blasts. ESD protection tailored for such applications may be achieved by protecting different zones using insulating or conducting layers.

Partially covering or wrapping an RCM can reduce its ESD sensitivity by modifying the current path. Sensitivity can be reduced by three mechanisms: 1) an alternate path for the ESD current is provided, reducing the amount of current that passes through the RCM; or 2) the ESD current is spread so that the current density is not high enough to ignite the RCM; or 3) the threshold for an ESD arc is raised beyond practical limits so that no arc forms.

Insulating or conducting layers may be advantageously applied to 1) the surfaces, 2) the edges, 3) a combination of surfaces and edges, or 4) the entire RCM. Different combinations of zones and layers provide respectively different levels of ESD protection appropriate for respectively different RCM applications.

Reducing the sensitivity of an RCM typically requires protection of the most sensitive zone. For instance, an insulating layer on only the surfaces of the RCM can reduce sensitivity if the surfaces are more subject to ignition than other zones. An insulating layer over the edges of a reactive foil can prevent arcing through the edge of the foil or can spread the arc to many points, reducing the current density at each point. An insulating layer covering one surface and the edges (or the entire foil) would have to undergo dielectric breakdown before current could travel to ground. The insulating layers should be between the RCM and the voltage source or ground, but they need not be in contact with the RCM to be effective. Thus, both insulating coatings and sheets can be effective insulating layers.

A conducting layer over the surfaces but not the edges of an RCM multilayer allows ESD current to spread before passing through the multilayer, thereby lowering the ESD current density. A conducting layer over the edges of a RCM allows an ESD arc at the edge to spread before the current travels through the multilayer. A conducting layer surrounding a multilayer foil provides a path for the current that can avoid the RCM multilayer entirely, or it can spread the current before it enters the multilayer. The surrounding conductor acts as a Faraday cage, keeping charge and current on the outer skin of the conducting layer. The conducting layer typically has a thickness of excess of about a micrometer.

Combinations of insulating and conducting layers can be devised to provide ESD protection without interfering with RCM applications. Insulating the edges and one major surface of an RCM foil while applying a conducting layer to the other major surface reduces ESD sensitivity without significantly affecting other ignition or emission behaviors. With this arrangement, the conducting surface is more likely to attract an ESD arc than the other surfaces and edges. The conducting layer spreads any ESD current before it passes into the multilayer, and the insulating layers would have to undergo dielectric breakdown before current could travel to ground.

Another arrangement stacks a combination of insulator and conductor in the same place. As examples, a metal tape with insulating adhesive, a polymer film with a metal layer on one side, or a metallized ESD bag can provide a conducting path around an RCM while ensuring that any current path through the multilayer has a high resistance.

Insulating layers for ESD protection of RCMs include but are not limited to ceramic coatings and insulating polymer films and coatings. Advantageous ceramics include oxides, nitrides, and carbides. Insulating ceramics or polymers can serve as substrates for the sputter deposition of RCM foils, or the insulating materials can be deposited on RCM foils during manufacture, via vapor deposition or any other suitable method. Aluminum oxide can be anodized on an aluminum layer on the surface of an RCM. Advantageous thicknesses are about a micrometer or more. Other ceramic layers may be grown thermally, chemically, or electrochemically, or by similar methods. Advantageous insulating polymers include PET, PTFE, PEN, insulating epoxies and insulating commercial anti-static coatings (OhmShield™ from Static Solutions, Inc., Sanpro Silver Lining™, Sprayon™ S00610 and Zero-charge Anti-Stat™ from Techspray). Such insulating polymers can be applied by spraying or painting. Other useful insulating layers include polymer tape (e.g. Kapton and ESD tape), castable ceramics, chemically applied insulators and even wood or paper.

Conducting layers for ESD protection of RCMs include but are not limited to films or coatings of metal such as aluminum, nickel, copper, indium, and lead-tin alloy. In addition, some commercial anti-static coatings are conducting. The conducting coatings can be applied to RCMs by any of a variety of processes including sputtering (aluminum or nickel), attachment (copper cladding, aluminum foil folded around the RCM), electro-chemical deposition (nickel), rolling or pressing (solder or braze alloys such as indium or tin-lead), and even by spraying or painting (commercial conducting coatings such as Nickel, Silver, and Gold Print). Also useful are metal tapes with conducting adhesive such as Saint Gobain Performance Plastics tapes. The conducting protective layer need not be continuous. A metal screen or mesh can be effective provided the mesh thickness and openings are scaled to divert an arc from the RCM to ground.

Combinations of insulating and conducting materials for ESD protection of RCMs include films and tapes that have both conducting and insulated surfaces. Examples include ESD bags that comprise an insulating polymer lining with a metal exterior and metal tape with an insulating adhesive. Tapes can also have insulating polymer outer surfaces and conducting adhesives or tapes can be wholly conducting or wholly insulating layers.

II. Advantageous Embodiments Of ESD Protected RCMs

One advantageous approach involves insulating a portion of the RCM but leaving at least one RCM surface uninsulated. This arrangement allows deliberate ignition of the RCM at the uninsulated surface using heat, laser, or other technique that would be difficult with a thick insulating layer in place. A thick insulating layer may also prevent transmission of light signals or heat from the RCM to the surroundings, impeding the usefulness of the RCM. In many cases, reducing the sensitivity of only the edges may provide adequate ESD protection, leaving the surfaces free to function as desired. A conducting layer on the uninsulated surface, such as a thick layer (greater than about one micrometer) of sputtered metal, impedes deliberate ignition much less than an insulating layer does. Thus, protecting the uninsulated surface with a thick conducting layer is a second advantageous approach.

Another advantageous approach—especially useful for RCMs disposed on conducting polymer backings—is to apply a conducting layer around the edges. If the polymer backing layer is metallized on the side distal the RCM, then a spark from the metallized polymer could jump to an unprotected RCM edge causing undesired ignition. Even coating the edge with insulating material might not prevent this occurrence. But a conducting layer, such as aluminum foil or metal tape with conducting adhesive, that is disposed around the edges provides a conducting path from the top surface of the RCM to the bottom metallized polymer. This path significantly reduces ESD risk.

In a first advantageous embodiment, shown in FIG. 1, an RCM foil 10 has a layer of metal 11 overlying one surface, a metallized polymer film 12 overlying the other surface, and conducting metal tape 13 overlying (wrapped around) the edges from one conducting surface to the other, directing current pulses around the reactive multilayer instead of through it to ground. The term "overlying" as used herein does not refer to "up/down" orientation but rather means the layer is adjacent the surface on the side away from the body. The term "layer" is intended to cover both a coating and a closely wrapped sheet such as a closely wrapped foil, film or tape. The terms "cover" refers to substantial covering, as small areas may be left exposed to permit deliberate ignition. This structure can also be used to protect the multilayer foil from accidental ignition by external radio frequency electromagnetic radiation.

As an example of the FIG. 1 embodiment, a copper tape with conducting adhesive was clamped around the edges of Ni—Al multilayer foil 30 μm thick with a 50 nm thick bilayer and 3 μm of Al on the surface that was sputter-deposited on a 125 μm thick metallized PET substrate. The edges of the multilayer and metallized film were entirely covered by the tape. The ignition threshold of the resulting samples was larger than 225 mJ, compared to 2 mJ for the multilayer and PET substrate but without tape around the edges. In an advantageous application, this foil is pressed against or wrapped around solid rocket propellant to act as an ignition source. The heat of the reaction is transmitted through the metal layer to the solid propellant, rapidly igniting a large area of the propellant surface.

Figure 2:
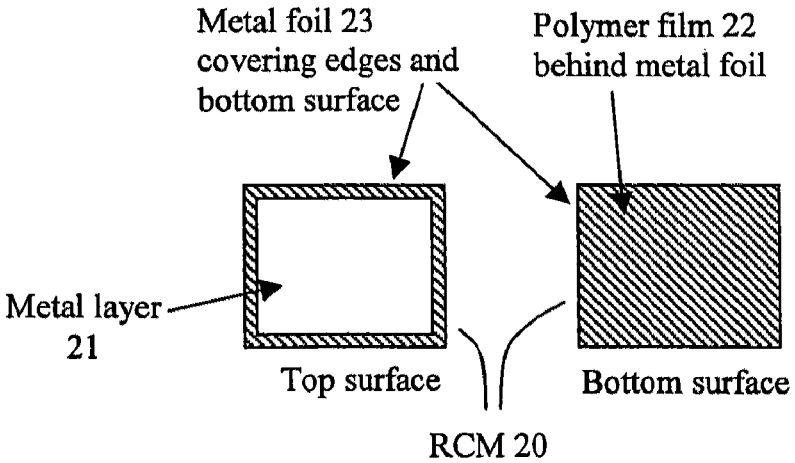
FIG. 2 schematically illustrates an RCM foil with a metal layer on the top surface, polymer layer on the bottom surface, and metal foil covering the edges and the polymer layer.

In a second embodiment, shown in FIG. 2, a reactive multilayer foil 20 has a layer of metal 21 on one surface, a metallized or non-metallized polymer film 22 on the other surface, and a conducting metal foil 23 wrapped around the edges and covering the insulating polymer film completely. An ESD current pulse delivered anywhere is transferred through the conducting layers to ground.

As an example of the FIG. 2 embodiment, a 12.7 μm thick aluminum foil was wrapped and clamped around the edges of a Ni—Al multilayer foil 30 μm thick with a 3 μm thick Al layer on the surface, deposited on a metallized PET substrate, in such a way that the surface and edges of the PET substrate, as well as the edges of the multilayer, were entirely covered by the aluminum foil. The ignition threshold of the resulting samples was larger than 225 mJ, compared to 2 mJ for the multilayer deposited on the PET substrate without the aluminum wrap.

In a third embodiment (FIG. 3), a reactive multilayer foil 30 has a layer of metal 31 on one surface, a non-metallized polymer film 32 on the other surface, and an insulating anti-static coating 33 on the edges, such that the edges and bottom surface are insulated and the top surface is conducting.

Figure 3:
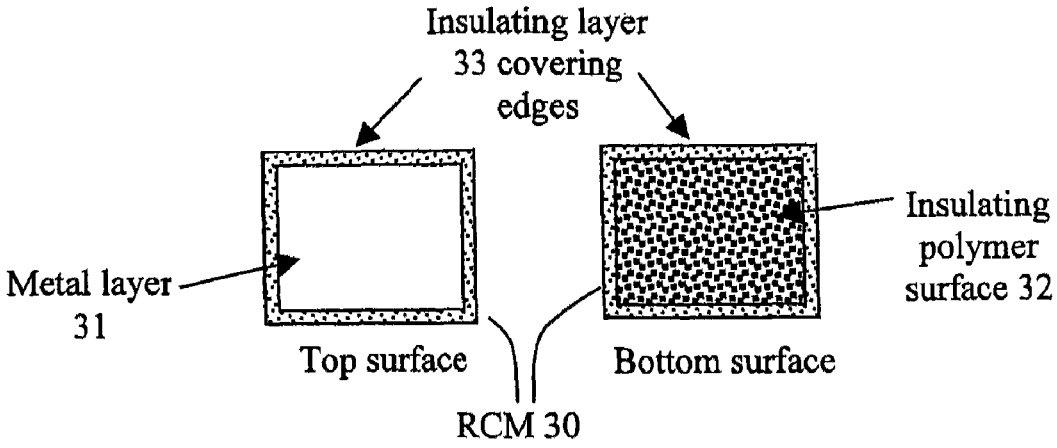
FIG. 3 schematically illustrates an RCM foil with a metal layer on the top surface, an insulating polymer on the bottom surface, and an insulating coating around the edges.

As an example of the FIG. 3 embodiment, a commercial ESD liquid coating, OhmShield™ AF6000, was used to cover the edges of a Ni—Al multilayer foil 30 μm thick with a 50 nm thick bilayer and a 3 μm thick Al layer on the surface, sputter-deposited on a 125 micron thick non-metallized PET substrate, in such a way that the edges of the multilayer and polymer film were entirely covered by about 0.5 mm of the dried ESD liquid coating. The ignition threshold of the resulting samples was larger than 125 mJ, compared to 2 mJ for the multilayer and PET substrate without the coating. Similarly, the insulating layer could be a partial wrapping in a nonconductive ESD bag, such that the bag fully covers one major surface and all edges of the RCM and partially covers the other major surface.

Figure 4:
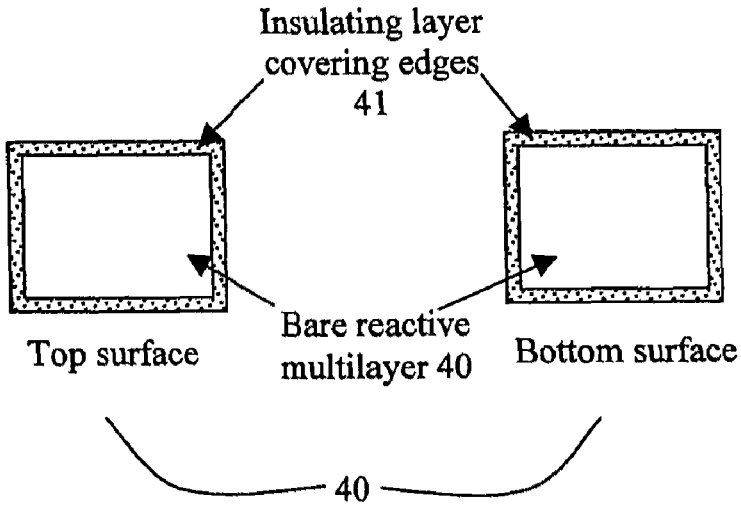
FIG. 4 schematically illustrates an RCM foil with an insulating coating around the edges.

In another embodiment (FIG. 4), the edges of a reactive multilayer foil 40 can be covered with an insulating coating 41 such as OhmShield™ AF 6000 that both reduces ESD sensitivity in the edges and exposes the surfaces to service conditions. Advantageously, this foil may be used for joining two components together with freestanding solder sheets, as the foil surfaces are wet by the molten solder during the reaction.

Figure 5A:
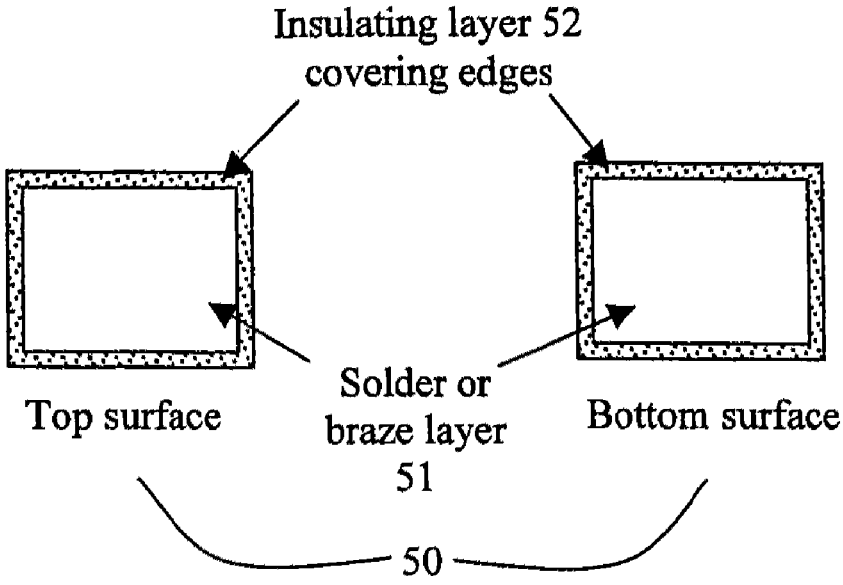
FIG. 5*a* schematically illustrates an RCM foil with a thick metal layer over the surfaces and an insulating coating around the edges.

In a fifth embodiment (FIG. 5A), a reactive multilayer foil 50 has a thick metal layer 51 pressed, rolled, or vapor-deposited onto both surfaces. The foil has its edges covered with an insulating coating 52 that both reduces ESD sensitivity in the edges and reduces the spray of the solder when the foil is ignited between two bodies to join the bodies together.

Figure 5B:
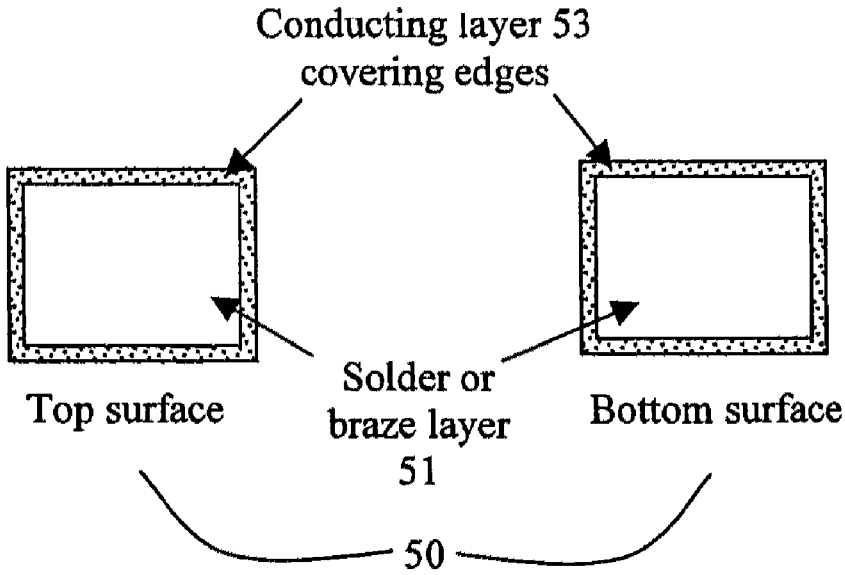
FIG. 5*b* schematically illustrates an RCM foil with a thick metal layer over the surfaces and a conducting coating around the edges.

In a variation of the fifth embodiment, (FIG. 5B), a reactive multilayer foil 50 with thick metal 51 pressed, rolled, or vapor-deposited onto both surfaces has its edges covered with a conducting coating or metallic film 53 clamped so that the metal layers on either side of the multilayer are connected electrically. This structure reduces ESD sensitivity in the edges and also protects the multilayer foil from external radio frequency electromagnetic radiation.

As an example of the fifth embodiment, copper tape was clamped around the edges of a mechanically formed Pd—Al multilayer foil 40 μm thick with a 200 nm (weighted average) bilayer in such a way that the edges of the multilayer were entirely covered by the tape. The ignition threshold of the resulting samples was larger than 6 mJ, compared to 2 mJ for the multilayer without tape around the edges.

Figure 6A:
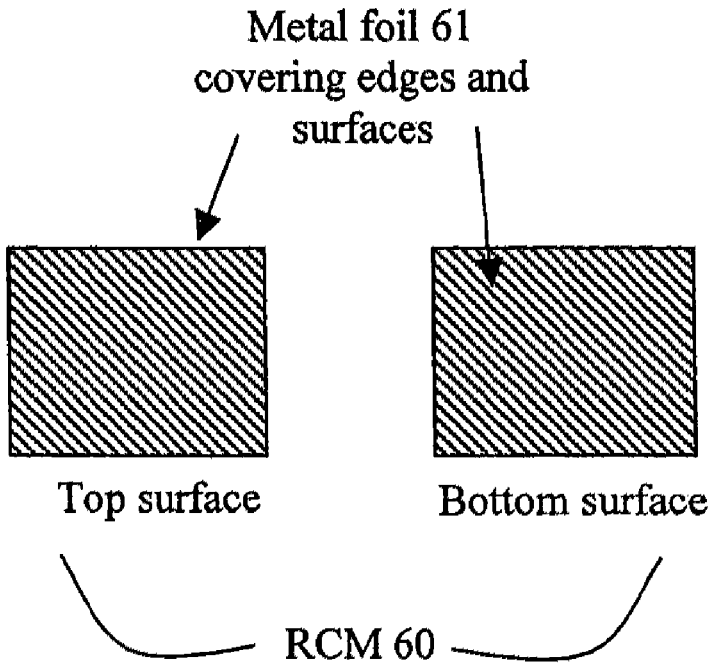
FIG. 6*a* schematically illustrates an RCM foil that is wrapped with metal foil or mesh.

In a sixth embodiment (FIG. 6A), an RCM 60 is wrapped with a metal foil or metal mesh 61. The metal foil or mesh is designed to permit sufficient heat transfer to the surroundings for the desired application.

For example, a Ni—Al multilayer foil 30 um thick with a 50 nm bilayer was wrapped with a 12 μm layer of aluminum foil. The energy required to ignite it was increased from 2 mJ to over 225 mJ. This structure can also be used to protect the multilayer foil from external radio frequency electromagnetic radiation.

Figure 6B:
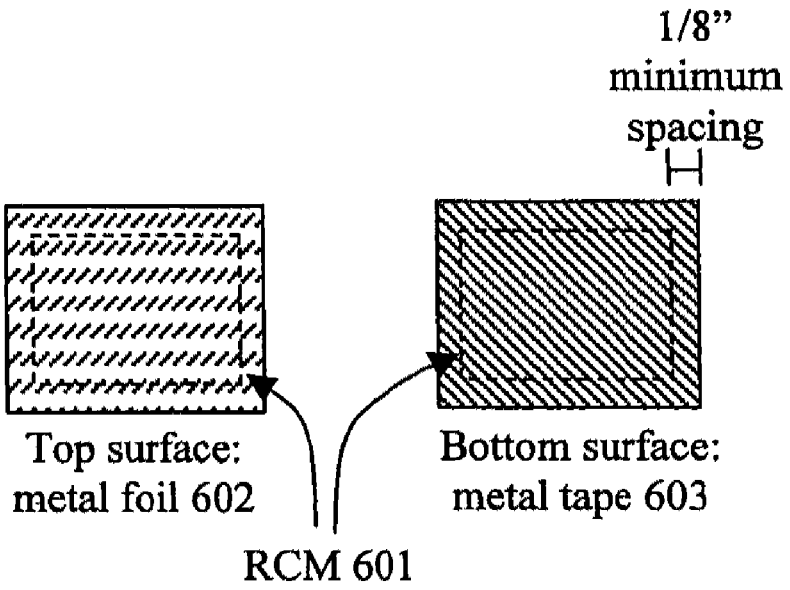
FIG. 6*b* schematically illustrates an RCM foil that is sandwiched between a sheet of metal foil and a sheet of metal tape, wherein the edges of the foil and tape extend beyond the RCM.

In a variation on the sixth embodiment (FIG. 6B), an RCM 601 is sandwiched between a metal foil 602 and a metal tape with conducting adhesive 603. Advantageously, the metal foil 602 and metal tape 603 extend at least ⅛" beyond the edges of the RCM.

For example, a Ni—Al multilayer foil 30 μm thick with a 50 nm thick bilayer that was sputter-deposited on a 125 micron thick non-metallized PET substrate was placed on a sheet of Saint Gobain Performance Plastics aluminum tape with conducting adhesive, PET against adhesive. A sheet of aluminum foil 12.5 μm thick of size equal to that of the aluminum tape was placed over the multilayer foil and the margins were pressed against the aluminum tape. When an ESD arc of 450 mJ was discharged directly into the edge of the sandwich, a margin 1/16" wide did not prevent ignition while a margin ⅛" wide prevented ignition. Advantageously, this geometry is effective for heating and for igniting solid rocket propellant.

Figure 7:
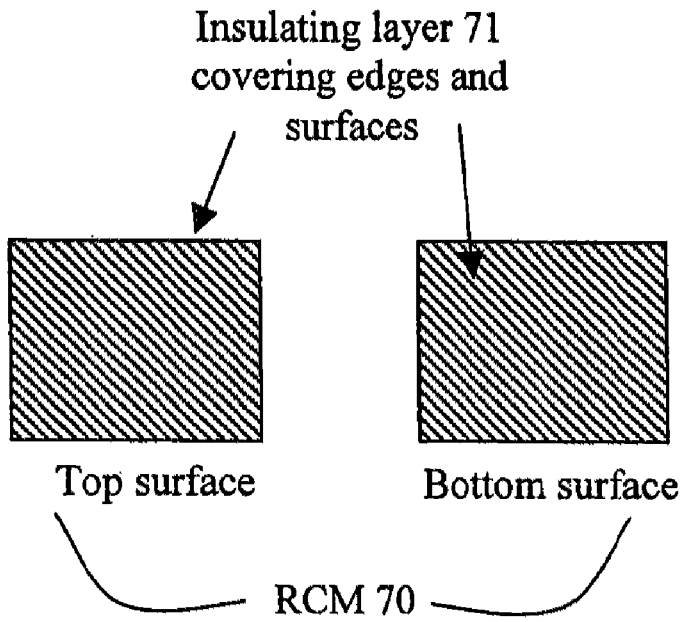
FIG. 7 schematically illustrates an RCM foil wrapped with an insulating layer.

In yet another embodiment (FIG. 7), an RCM 70 is completely covered with an insulating layer 71. As a first example of the FIG. 7 embodiment, a Pd—Al multilayer foil 40 μm thick with a 200 nm (weighted average) bilayer was wrapped in an ESD bag. The ignition threshold of the sample was larger than 30 mJ, compared to 2 mJ for the reactive multilayer foil without the bag.

As a second example, a mechanically formed Ni—Al reactive multilayer foil 40 μm thick with a 200 nm thick bilayer (weighted average) was completely covered with about 0.5 mm of a dried commercial ESD liquid coating OhmShield™ AF 6500. The covered sample was less sensitive to ESD, requiring over 150 mJ for ignition versus 6 mJ for the same foil without the AF 6500 coating.

Figure 8:
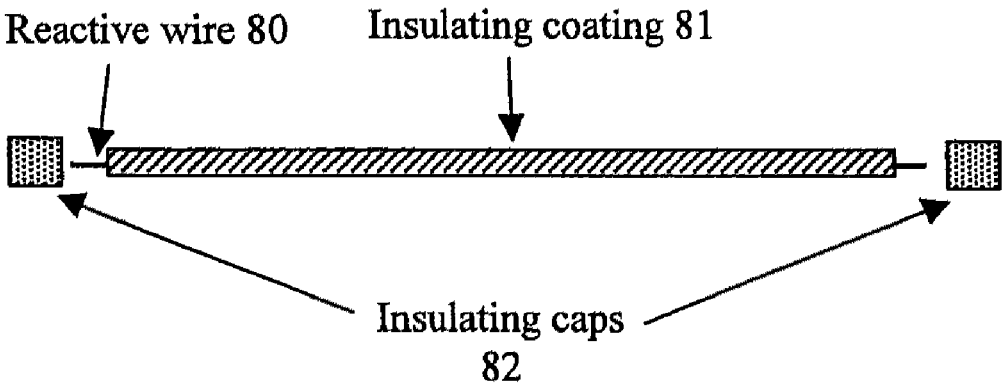
FIG. 8 schematically illustrates an RCM wire with an insulating coating on the surface and ends protected with temporary insulating caps.

In another advantageous embodiment (FIG. 8), a reactive composite wire 80 is covered with standard polymer wire insulation 81. The ends are protected with temporary insulating caps 82. Upon removal of the caps, the ends can be ignited.

In another embodiment (FIG. 9), a three-dimensional reactive composite structure 90 comprising RCM is coated completely with insulating or conducting material 91. The structure is composed to be ignited by impact.

Figure 9:
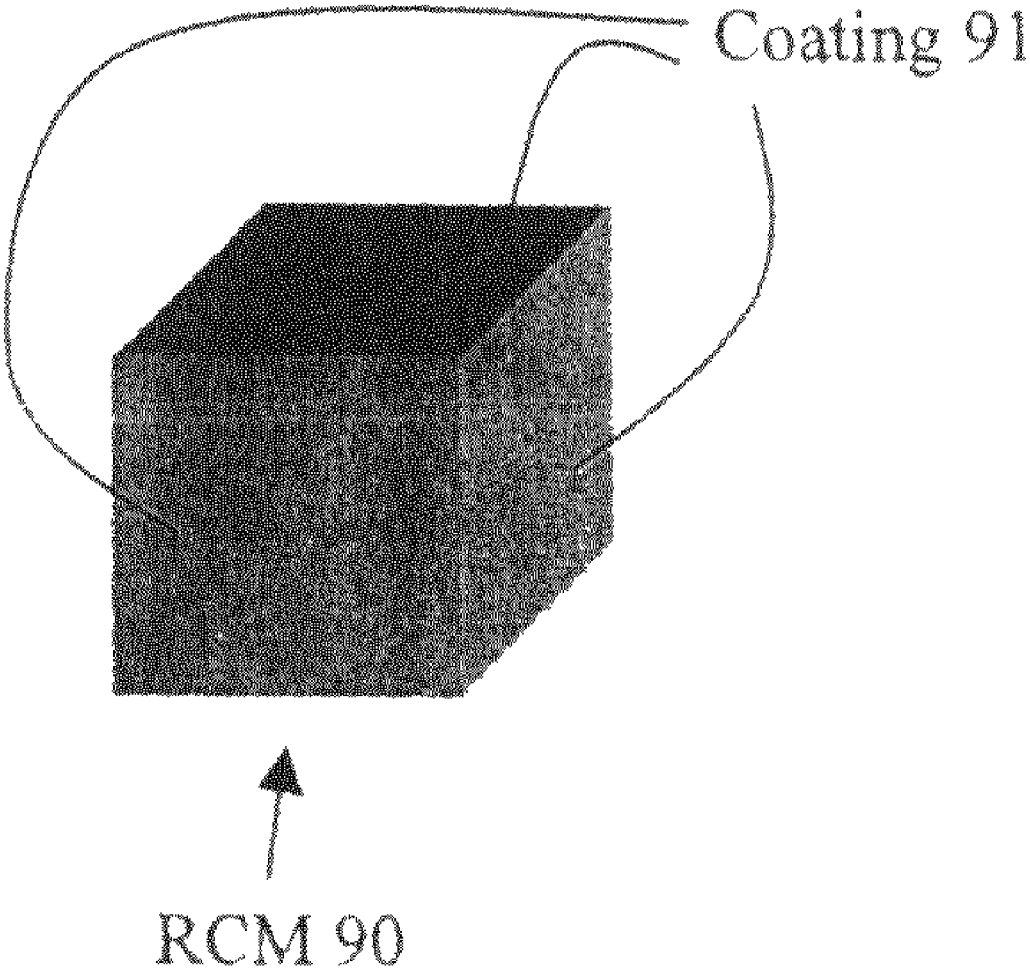
FIG. 9 schematically illustrates a reactive composite structure with an insulating or conducting coating on surface.

As a hypothetical example of the FIG. 9 embodiment, a cube 90 comprising 0.5 mm thick pieces of RCM plate glued together may be coated (91) with a commercial anti-static coating, such as OhmShield™ AF6000. The cube could alternatively be sealed in an ESD bag, incidentally under a protective atmosphere to reduce corrosion or other aging effects. The cube could also be wrapped in aluminum or titanium foil, providing a conducting layer that might also burn in air upon ignition of the cube.

It can now be seen that in one aspect, the invention comprises a body of reactive composite material subject to ignition having one or more edges, surfaces or corners protected from unwanted ignition by a layer of electrically insulating material, electrically conducting material or a combination of electrically insulating material and electrically conducting material. The layer can be chosen and configured to provide an alternative path to ESD current that does not pass through the body. Alternatively, the layer can be chosen and configured to spread ESD current before the current reaches the body and thus reduce ESD current density in the body, or the layer can be chosen and configured to increase the threshold for ESD arcing so that no ESD arc forms.

The layer can comprise insulating material that overlies one or more surfaces of the body, overlies one or more edges of the body, overlies at least one surface and at least one edge, overlies at least one surface, at least one edge and at least one corner or overlies substantially the entire body. Alternatively, the layer can comprise conducting material that overlies at least one surface of the body, at least one edge of the body, at least one surface and at least one edge of the body, overlies at least one surface, at least one edge and at least one corner of the body or overlies substantially the entire body. The layer can also alternatively comprise a combination of insulating material and conducting material.

In another aspect, the invention comprises a body of reactive composite material subject to ignition having first and second surfaces and edges between the first and second surfaces wherein the body is protected from unwanted ignition by a layer of conducting material overlying the first surface, a layer of conducting material overlying the second surface and a layer of conducting material overlying the edges. The conducting layer can be metal or conducting tape. Advantageously, the conducting material overlying the edges extends from the layer overlying the first surface to the layer overlying the second surface.

In a third aspect, the invention comprises a body of reactive composite material subject to ignition having first and second surfaces and edges between the surfaces wherein the body is protected from unwanted ignition by a layer of conducting material overlying the first surface and an insulating layer overlying the second surface. A layer of conducting material can be wrapped around the edges and partially or completely cover the insulating layer. Alternatively, a layer of insulating material can extend around the edges.

In another aspect, the invention comprises a body of reactive composite material subject to ignition having first and second surfaces and edges between the surfaces wherein the body is protected from unwanted ignition by covering the first surface, the edges and only a portion of the second surface with one or more insulating layers.

Yet another aspect of the invention is a method of protecting from unwanted ignition a body of reactive composite material subject to ignition by providing a body of reactive composite material having one or more edges, surfaces and corners and disposing on one or more of the edges, surfaces or corners at least one layer of insulating material, conducting material or a combination of insulating material and conducting material.

It is to be understood that the above-described embodiments illustrate only a few of the many possible arrangements that can be devised using the principles of the invention. Those skilled in the art can make many variations and modifications without departing from the spirit and scope of the invention.

What is claimed is:

1. A body of nano-structured reactive composite material subject to ignition by a self-propagating exothermic chemical reaction, having one or more edges, surfaces, or corners protected against unwanted electrical ignition by at least one applied layer of electrically insulating material, electrically conducting material, or a combination of electrically insulating material and electrically conducting material.

2. The body of reactive composite material of claim 1 wherein the at least one layer is chosen and configured to provide an alternative path to electrostatic discharge current that does not pass through the body.

3. The body of reactive composite material of claim 1 wherein the at least one layer is chosen and configured to reduce the electrostatic discharge current density in the body.

4. The body of reactive composite material of claim 1 wherein the at least one layer is chosen and configured to increase the threshold for electrostatic discharge arcing.

5. The body of reactive composite material of claim 1 wherein the at least one layer comprises a conducting layer having a thickness greater than about one micrometer.

6. The body of reactive composite material of claim 1 wherein the at least one layer comprises a layer of insulating material.

7. The body of claim 6 wherein the layer of insulating material overlies at least one surface of the body.

8. The body of claim 6 wherein the layer of insulating material overlies at least one edge of the body.

9. The body of claim 6 wherein the layer of insulating material overlies at least one corner of the body.

10. The body of claim 6 wherein the layer of insulating material overlies at least one surface and at least one edge of the body.

11. The body of claim 6 wherein the layer of insulating material overlies at least one surface, at least one edge and at least one corner of the body.

12. The body of claim 6 wherein the layer of insulating material overlies substantially the entire body.

13. The body of reactive composite material of claim 1 wherein the at least one layer comprises conducting material.

14. The body of claim 13 wherein the conducting layer overlies at least one surface of the body.

15. The body of claim 13 wherein the conducting layer overlies at least one edge of the body.

16. The body of claim 13 wherein the conducting layer overlies at least one surface and at least one edge of the body.

17. The body of claim 13 wherein the conducting layer overlies at least one corner of the body.

18. The body of claim 13 wherein the conducting layer overlies at least one surface, at least one edge and at least one corner of the body.

19. The body of claim 13 wherein the body with the conducting layer exhibits the degree of electrostatic discharge protection designated class 3B using the Human Body Model specified in ANSI-STM5.1-2001.

20. The body of claim 13 wherein the conducting layer overlies substantially the entire body.

21. The body of claim 13 wherein the conducting layer is flammable in air.

22. The body of reactive composite material of claim 1 wherein the at least one layer comprises a combination of insulating material and conducting material.

23. The body of claim 22 wherein the combination layer overlies at least one surface of the body.

24. The body of claim 22 wherein the combination layer overlies at least one edge of the body.

25. The body of claim 22 wherein the combination layer overlies at least one surface and one edge of the body.

26. The body of claim 22 wherein the combination layer overlies at least one corner of the body.

27. The body of claim 22 wherein the combination layer overlies at least one surface, one edge and one corner of the body.

28. The body of claim 22 wherein the combination layer overlies substantially the entire body.

29. The body of reactive composite material of claim 1 wherein the at least one layer comprises an insulating ceramic or polymer.

30. The body of reactive composite material of claim 1 wherein the at least one layer comprises a ceramic selected from the group consisting of oxides, nitrides, carbides, and insulating ceramics.

31. The body of reactive composite material of claim 1 wherein the at least one layer comprises anodized aluminum oxide.

32. The body of reactive composite material of claim 1 wherein the at least one layer comprises an insulating polymer selected from the group consisting of polyethylene terephthalate, polytetrafluoroethylene, polyethylene naphthalate, insulating epoxy, insulating anti-static coatings, and polymer tape.

33. The body of reactive composite material of claim 1 wherein the at least one layer comprises a metal foil or tape.

34. The body of reactive composite material of claim 1 wherein the at least one layer comprises a sputtered metal layer greater than 1 μm thick.

35. A method of protecting from unwanted ignition a body of nano-structured reactive composite material subject to ignition comprising the steps of:

providing a body of nano-structured reactive composite material comprising two or more solid materials with large negative heats of mixing which are spaced throughout a composite and which are ignitable to support self-propagating exothermic chemical reactions, having one or more edges, surfaces and corners; and disposing on one or more of the edges, surfaces or corners at least one layer of electrically insulating material, electrically conducting material or a combination of electrically insulating material and electrically conducting material.

36. The method of claim 35 wherein the at least one layer comprises a layer of insulating material.

37. The method of claim 35 wherein the at least one layer comprises a layer of conducting material.

38. The method of claim 35 wherein the at least one layer comprises a composite layer of conducting material and insulating material.

39. The method of claim 35 wherein the at least one layer is disposed on the body by a method selected from the group consisting of vapor deposition, sputtering, thermal oxidation, chemical oxidation, chemical reaction, electrochemical oxidation and electrochemical deposition.

40. The method of claim 35 wherein the at least one layer is disposed on the body by a method selected from the group consisting of cladding, pressing, spraying or painting.

* * * * *